United States Patent [19]

Bo

[11] Patent Number: 4,599,942

[45] Date of Patent: Jul. 15, 1986

[54] COLD MARKING TYPESETTING STICK CARTRIDGE STAMPING TOOL

[75] Inventor: Ermano Bo, Ternay, France

[73] Assignee: Societe B.B.M. S.A., Feyzin, France

[21] Appl. No.: 139,026

[22] Filed: Apr. 10, 1980

[30] Foreign Application Priority Data

May 18, 1979 [FR] France ..... 79 13540

[51] Int. Cl.[4] ..... B41J 1/48

[52] U.S. Cl. ..... 101/18; 101/29; 101/110

[58] Field of Search ..... 101/18, 4, 42, 29, 41, 101/43, 44, 35, 110, 21, 93.47, 93.21, 93.24, 93.26, 93.32, 93.28, 99, 19, 106, 107, 108; 411/24, 26

[56] References Cited

U.S. PATENT DOCUMENTS

| | | | |
|---|---|---|---|
| 1,005,090 | 10/1911 | Wickes | 101/29 |
| 1,038,834 | 9/1912 | Bloom | 411/24 |
| 1,393,170 | 10/1921 | Schmidinger | 101/29 |
| 2,003,218 | 5/1935 | Pearson | 101/93.24 |
| 2,073,154 | 3/1937 | Hoffmann | 101/29 |
| 2,546,114 | 3/1951 | Triplett et al. | 72/404 X |
| 2,949,079 | 8/1960 | Beattie | 101/35 |
| 3,169,474 | 2/1965 | Howard | 101/110 |
| 3,227,071 | 1/1966 | Szczepanski | 101/93.47 X |
| 3,738,264 | 6/1973 | Sabottka et al. | 101/99 X |
| 3,757,688 | 9/1973 | Weber | 101/99 X |
| 3,832,946 | 9/1974 | Lupkas et al. | 101/93.20 X |
| 3,902,409 | 9/1975 | Filsinger et al. | 101/27 |
| 4,006,786 | 2/1977 | Speicher | 101/3 R |
| 4,015,521 | 4/1977 | Neff | 101/99 |
| 4,018,154 | 4/1977 | Matsumoto et al. | 101/99 X |
| 4,064,802 | 12/1977 | Funahashi | 101/110 X |
| 4,265,172 | 3/1981 | El-Souessi | 101/29 |

FOREIGN PATENT DOCUMENTS

| | | | |
|---|---|---|---|
| 574363 | 4/1933 | Fed. Rep. of Germany | 101/110 |
| 2167982 | 8/1973 | France . | |
| 2318744 | 2/1977 | France . | |
| 2389425 | 12/1978 | France . | |

OTHER PUBLICATIONS

IBM *Technical Disclosure Bulletin*, "Flexible Print Stick", N. Rogers, vol. 3, No. 6, Nov. 1960.

*Primary Examiner*—Edgar S. Burr
*Assistant Examiner*—Charles A. Pearson
*Attorney, Agent, or Firm*—Sandler & Greenblum

[57] ABSTRACT

A stamping tool used for cold marking comprising a container and at least one marking element. Each of the marking elements is a rotatable wheel mounted to rotate individually whereby the character stamped may be changed. The marking elements are mounted in the container in a manner such that the rotatable wheels may be manually rotated without dismantling the tool. Each wheel extends beyond the container in a lateral direction to permit manual adjustment of the wheel and downwardly below the container to facilitate marking with the wheel. A plunger is supported on the marking elements, and is adapted to be hit by a piston.

14 Claims, 7 Drawing Figures

COLD MARKING TYPESETTING STICK CARTRIDGE STAMPING TOOL

BACKGROUND OF THE INVENTION

1. Field of the Invention

The present invention relates to a typesetting stick for a cartridge stamping tool used for cold marking of the type comprising, in a container, a plunger adapted to be hit by the piston of the stamping device. The plunger is supported against marking elements individually held in the container which comprise means adapting them to the barrel of the stamping tool, such means particularly comprising a sealing pistol.

2. Description of the Pior Art

French Pat. No. 2,389,425 describes a stamping device characterized by the fact that it comprises a plurality of punches arranged in the form of bars guided individually in hollow passages arranged in parallel or radially in the container closed by a cover comprising a shoulder against which the heels of the punches abut. The container is provided with a cavity which extends beyond the guiding passages of the punches and in which is included a plunger whose base is adapted to hit the upper ends of the punch.

Such an apparatus possesses substantial strength and is readily adapted for use. However, it is difficult to change the characters displayed. In effect, it is necessary to open the container to replace one punch by another such that this type of apparatus is convenient only for stamping identical inscriptions which are to be repeated a considerable number of times. Such a device is less useful when it is used for stamping characters which change very frequently because the time wasted in changing the punches renders the operation very inconvenient.

SUMMARY OF THE INVENTION

It is an aim of the invention to overcome the above and other disadvantages.

As disclosed, the invention overcomes the problem of repeatedly changing the punches to achieve different markings. This is done by using rotatable serrated wheels arranged side by side in a container. The container comprises a hollowed body closed at two sides by side plates and which is adapted to be hit by a plunger itself being hit by the piston of the stamping tool with which the typesetting stick is used. Each serrated wheel is guided by cutouts provided in the side plates of the container. The wheel extends below the sides at its bottom for marking and extends laterally beyond the sides so that the wheels may be manipulated.

An advantage of the device of the invention is that it is not necessary to open the container to set the device as desired such that the desired marking is obtained and it is necessary only to turn one or more serrated wheels to generate the number, group of letters or necessary signs which are desired and which results in appreciable savings of time.

BRIEF DESCRIPTION OF DRAWINGS

The invention will be more fully understood with reference to the annexed drawings, illustrating one embodiment of the invention only, in which.

DESCRIPTION OF PREFERRED EMBODIMENTS

Figure 1:
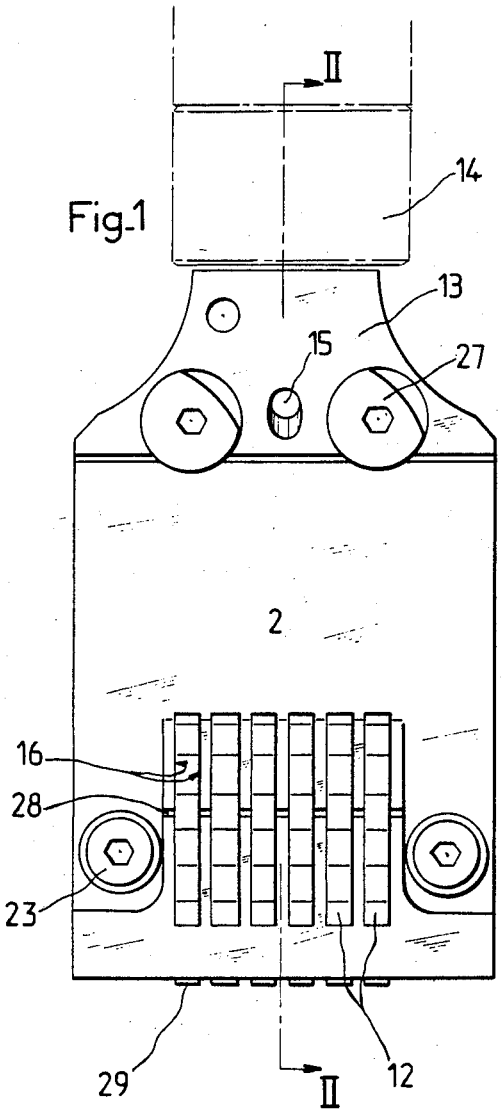
FIG. 1 is a front elevational view of one side of the typesetting stick enclosed by one of its side plates.
Figure 2:
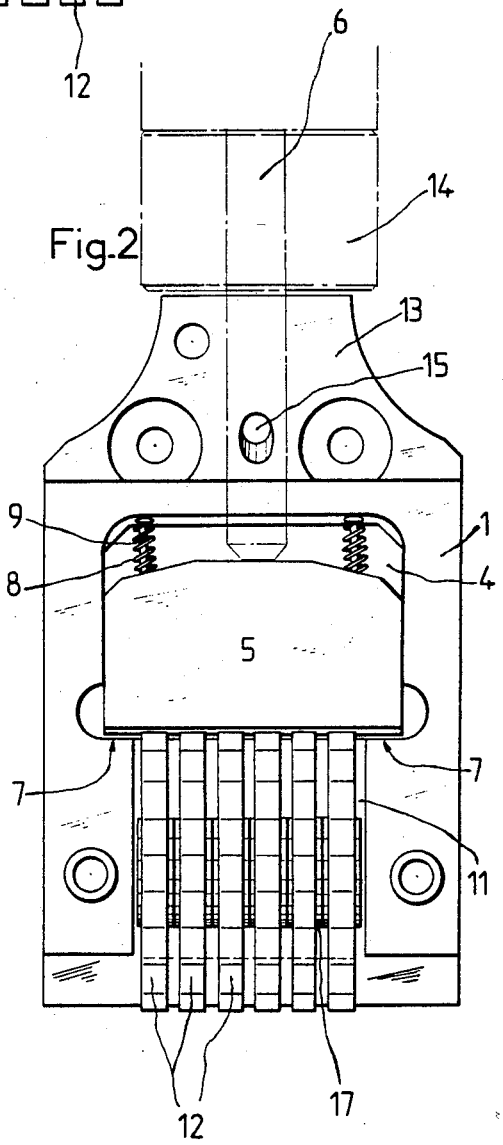
FIG. 2 is an elevational view of the side of the typesetting stick of FIG. 1 with the side removed such that the plunger biased by the springs and the serrated wheels arranged side by side in their holder are shown.
Figure 4:
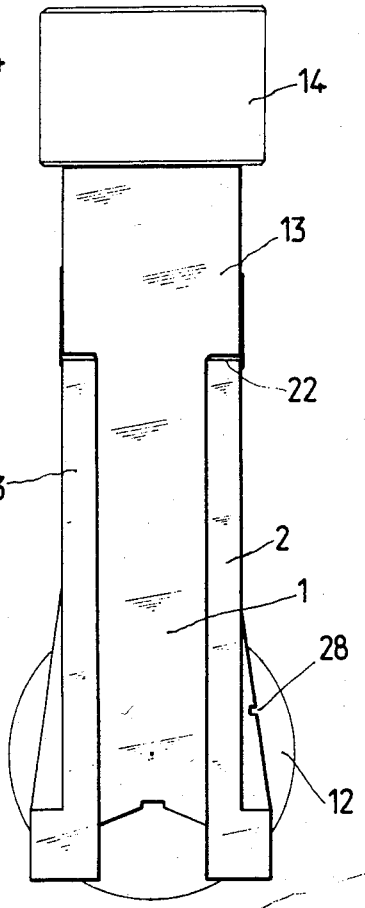
FIG. 4 is a side elevational view of the typesetting stick enclosed by its side plates.
Figure 5:
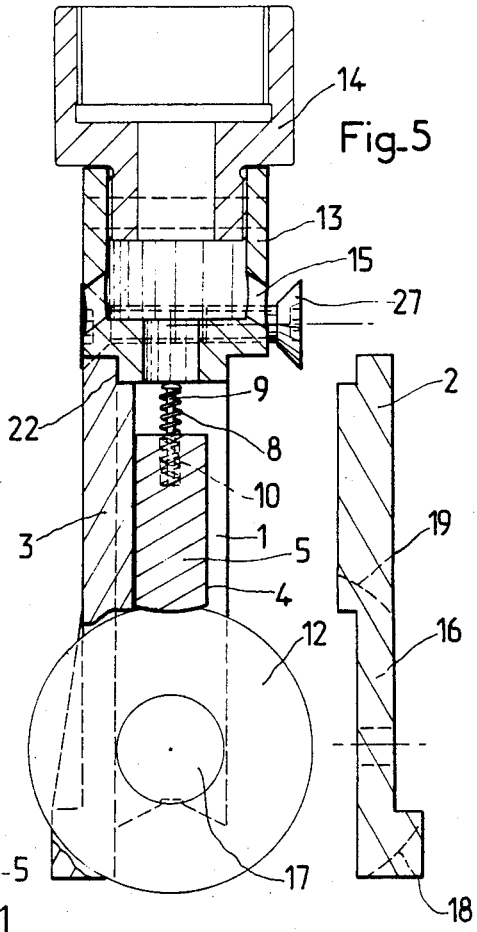
FIG. 5 is a cross sectional view along II—II of FIG. 1 with one of the sides plates removed.

The typesetting stick comprises a container constituted by a hollowed body 1, as is shown clearly in FIG. 2, and two side plates 2 and 3 which may be seen with reference to FIGS. 4 and 5. FIG. 1 illustrates the typesetting stick as seen from the front of the side plate 2 attached to the hollowed body 1.

When the side plates 2 and 3 are attached to the hollow body 1, a space is formed between the side plates and the plunger housing 4 (FIGS. 2 and 5) in which a a generally rectangular plunger 5 having an upper surface with a plurality of facets is displaced. The plunger is hit by the piston 6 of the stamping tool and the movement of the plunger is limited by the stops formed by the two shoulders 7 of the hollow body 1.

As may be seen with reference to FIG. 2, an empty space 11 is present beneath the plunger housing 4 of the plunger 5. The empty space 11 results from the attachment of the side plates 2 and 3 to the hollow body 1 and rotatable serrated wheels 12 which are hit by the plunger 5 are positioned side by side therein. The plunger 5 is maintained such that it is supported against the concave faces of the serrated wheels by two springs 8. These springs are each guided by a coaxial shaft 9 whose head is supported against the bottom of the housing 4 and whose body is positioned in a blind hole 10 hollowed out in the upper portion of the plunger 5.

As seen in FIGS. 1, 2, 4 and 5, the hollowed body 1 ends in a tail portion 13 on which an adapter 14 is screwed for connecting the hollowed body to the barrel of the stamping pistol. Two cavities 15 are hollowed out in the tall portion 13 (one on each side) so as to place the upper portion of the plunger cavity in contact with the atmosphere and to allow for the evacuation of gas.

Side plates 2 and 3 (front view of FIG. 1) have a generally rectangular shape. As shown in FIGS. 4 and 5, the base of each of side plates 2 and 3 is thicker so as to allow for the machining of rectangular cutouts 16 hollowed out vertically and between the lateral faces from which the serrated wheels are individually guided but are free to be rotated.

Each rotatable serrated wheel 12 is of a generally circular shape and machined to provide a concentric axle or shoulder 17 adapted to act as a shoulder or stop for the serrated wheel against the solid portions of the side plates 2 and 3 provided between the cutouts 16.

Figure 3:
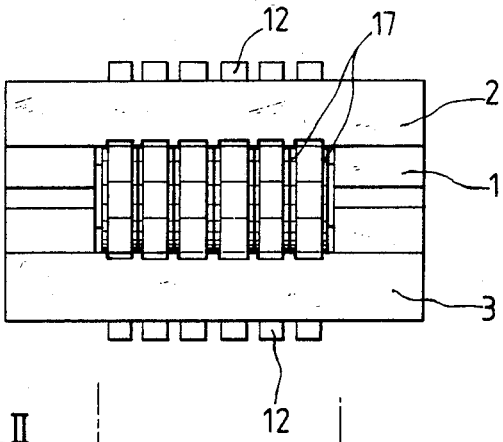
FIG. 3 is a bottom planar view of the typesetting stick.

The serrated wheels are arranged side by side, with their respective shoulders or axles in contact (see FIGS. 2 and 3) with the adjacent serrated wheel. The wheels rest vertically on the arcs 18 extending from the cutouts 16 at the outer surface of the side plates to the bottom edge of the internal surface of the side plates while the upper surface of the arcs 19 act as stops when the wheel is retracted. These arcs have a radius substantially equal to that of the serrated wheels while allowing for rotation of the wheels therein. The marking elements or serrated wheels are mounted in the container without an axle common to the marking elements.

The space provided between the internal surfaces of the side plates 2 and 3 is equal to the diameter of the shoulders or axles 17 of the serrated wheels such that, when the side plates are attached to the body 1, the serrated wheels can move in only two directions, i.e., they can rotate around their own axis, and they can reciprocate vertically when the plunger hits them.

Figure 6:
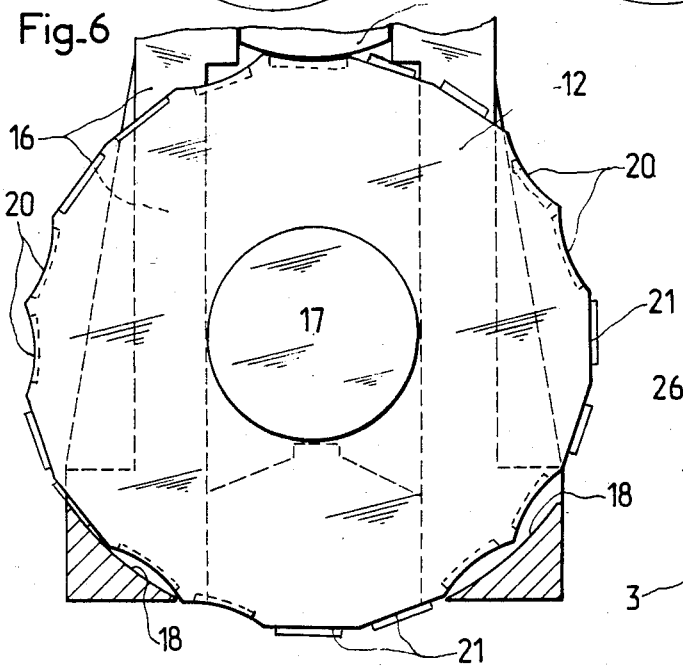
FIG. 6 is a detailed view on a magnified scale with a serrated wheel in its holder.

Each serrated wheel 12 comprises facets on its rim as may be seen in FIG. 6. Facets 20, which are shown as being concave, are percussion facets adapted to receive the percussion of the plunger 5 which itself is of a generally convex shape having a curvature corresponding to that of the percussion facets. The facets 20 are engraved or hollowed out with numbers, letters, symbols or the like which appear raised on the marking facets 21 adapted for marking. The raised indicia are shown by solid lines on facets 21, and the engraved indicia by dotted lines on facets 20.

Figure 7:
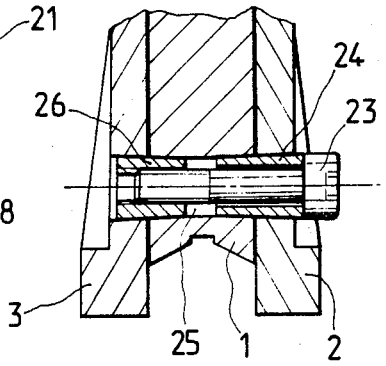
FIG. 7 is a side cross sectional view of the assembly with frustoconical pins of the sides with the hollowed body.

Side plates 2 and 3 are rabbet fitted in a joint 22 (FIGS. 4 and 5) with the hollowed body 1 and are each attached to the base of the container by a sets of two frustoconical pins shown in FIG. 7, held by a screw having a hollowed or slitted head such as an Allen head screw, which may, for example, go through the first pin 24, a tightening space 25, which is threaded into the second pin 26 and, at the upper portion of the container by two screws 27, whose head holds the upper edge of each side plate (FIGS. 1–5).

In the embodiment which has just been described, marking is performed on planar surfaces. In other embodiments of the invention the typesetting stick can be adapted so as to stamp curved surfaces. To achieve this, the serrated wheels are, in one embodiment, arranged in a fashion so as to converge downwardly to mark a convex surface. In another embodiment, they diverge downwardly so as to mark a concave surface.

In the first case, the marking facets of the plunger and of the container have a concave form, while in the second case the marking facets of the plunger and of the container have a convex form.

In order to mark a surface by means of the typesetting stick of the invention, one selects the characters, numbers or the like which are desired and one selects, within the series of serrated wheels available, those which correspond to the desired characters. The container is opened by partially unscrewing the screw 27 in a manner so as to pivot the heads of the screws such that they permit the upper edge of the sides 2 and 3 to escape and then the screws 23 are lifted so as to remove one of the side plates 2 or 3.

The serrated wheels are arranged side by side by engaging them in the cutouts 16 of the remaining side. The removed side is then replaced and screwed on.

Each serrated wheel can be rotated with a finger until the number or character desired appears at the reference level 28 (FIG. 1) which is reproduced by the characters in relief in zone 29 which will be in contact with the surface to be marked and on which the typesetting stick will be placed. By placing the stick on the surface to be stamped the serrated wheels 12 are driven back into contact with the plunger 5 which is itself pushed back in the housing 4 so that it touches the springs 8.

The explosion of the cartridge of the stamping tool projects its piston 6 against the plunger 5 which transmits the shock to the percussion facets 20 of the serrated wheels 12 against which it is supported. Marking occurs and the recoil of the serrated wheels and of the plunger is cushioned by the springs 8. Gases are vented through orifices 15. The force imposed upon the serrated wheels 12 forces each of the wheels downwardly, i.e., outwardly from the lower surface of side plates 2 and 3, so that each of the wheels can independently move outwardly from the side plates and into contact with a portion of a surface being marked or stamped. Accordingly, each of the wheels which moves independently will independently or individually mark or stamp the surface.

The typesetting stick which has been described above may additionally comprise an appropriate adapter 14 attached to the tail portion of the stamping tool, and may be screwed on and/or wedged on or attached by means of notches.

Although the invention has been described with respect to particular materials, means and the like, it is to be understood that the invention is not limited to the particulars disclosed and extends to cover all embodiments included within the scope of the claims.

What is claimed is:

1. A stamping tool used for cold-marking a surface by stamping which comprises:

(a) a container;

(b) a plurality of marking elements for stamping characters on said surface, each of said marking elements comprising a rotatable wheel mounted to rotate independently in order to change the characters to be stamped by said wheels, means for mounting said marking elements without a common axle in said container in order to permit both independent rotation and independent vertical movement of said wheels, said wheels extending beyond said container in a lateral direction to permit adjustment of said wheels and downwardly below said container to facilitate marking; and (c) a plunger supported on said marking elements, said plunger being adapted to be hit by a piston and said marking elements being adapted to be hit by said plunger.

2. A stamping tool used for cold-marking a surface by stamping characters thereon, said tool comprising a container having an inner surface and a plurality of rotatable marking wheels which are mounted within said container for both independent rotation and independent vertical movement, said container including a plurality of cutouts, a portion of said cutouts being defined by said inner surface, each of said wheels being accommodated by and engaged within one of said cutouts.

3. A stamping tool used for cold-marking a surface by stamping, said tool comprising:

(a) a container;

(b) a plurality of marking elements for stamping said surface with characters, each of said marking elements being a rotatable wheel;

(c) means for mounting said wheels without a common axle and within said container for independent movement, so that said wheels can be independently manually rotated to change the position of characters to be stamped on said surface without dismantling said tool and so that said wheels can be independently vertically moved within said container to facilitate marking of said surface, each of said wheels extending beyond said container in a lateral direction to permit said manual wheel adjustment and downwardly below said container to facilitate marking said surface; and (d) a plunger supported on said marking elements, said plunger adapted to be hit by a piston and to hit said marking elements in order to mark said surface.

4. The stamping tool as defined by claim 3 wherein said container comprises two side plates and each of said marking elements extends laterally beyond and downwardly below each of said side plates.

5. The stamping tool as defined by claim 3 wherein each rotatable wheel has a rim comprising marking facets and percussion facets distributed over said rim.

6. The stamping tool as defined by claim 5 wherein said percussion facets have a shape adapted to that of said plunger and said marking facets have a shape corresponding to a surface to be marked.

7. The stamping tool as defined by claim 6 wherein said percussion facets are concave and the characters to be stamped are mounted in relief on said marking facets and are carved into said percussion facets.

8. The cartridge stamping tool as defined by claim 3 wherein said container is a body having a hollowed portion in which said marking elements are arranged.

9. The stamping tool as defined by claim 8 wherein said container comprises two spaced apart side plates, each of said side plates comprising at least one cutout adapted to accomodate portions of each of said wheels which extend laterally beyond said container.

10. The stamping tool as defined by claim 9 wherein said cutouts are each bordered by upper and lower arcs adapted to limit the vertical movement of said marking elements and wherein the radius of each of said wheels is substantially equal to the radius formed between each of said arcs and the center of a circle which includes said arcs.

11. The stamping tool as defined by claim 9 wherein said rotatable wheels are circular and machined so as to provide circular shoulders, concentric with said wheel, which extend laterally from each side of the center of each of said wheels, each of said shoulders having a diameter which is substantially equal to the spacing between said side plates such that lateral surfaces of said shoulders extend to said side plates so that each of said wheels is rotatable and is held within said hollowed body by virtue of the lateral surfaces of each of said shoulders.

12. The stamping tool as defined by claim 8 wherein each of said side plates is rabbet fitted onto said hollowed body.

13. The stamping tool as defined by claim 3 wherein said plunger is maintained in contact with said marking elements by two springs, each of said springs being guided by a shaft arranged coaxially therewith.

14. The stamping tool as defined by claim 3 wherein each of said rotatable wheels is circular and includes two sides having center portions and shoulders which are concentric with the center of said wheels and which extend laterally from each of said sides, said plurality of wheels positioned adjacent to one another so that shoulders of adjacent wheels are in contact.

* * * * *